US007237675B2

(12) United States Patent
O'Malley

(10) Patent No.: US 7,237,675 B2
(45) Date of Patent: Jul. 3, 2007

(54) BOTTLE CRADLE STACKING SUPPORT

(76) Inventor: Joseph O'Malley, 251 W. Taylor Rd., Selah, WA (US) 98942

( * ) Notice: Subject to any disclaimer, the term of this patent is extended or adjusted under 35 U.S.C. 154(b) by 205 days.

(21) Appl. No.: 10/410,754

(22) Filed: Apr. 9, 2003

(65) Prior Publication Data

US 2004/0031711 A1 Feb. 19, 2004

Related U.S. Application Data

(60) Provisional application No. 60/371,344, filed on Apr. 9, 2002.

(51) Int. Cl.
*B65D 65/00* (2006.01)
*B65D 75/00* (2006.01)

(52) U.S. Cl. ..... 206/433; 206/431; 206/592; 206/593

(58) Field of Classification Search ..... 206/203, 206/427, 431, 433, 521, 523, 592, 593, 594
See application file for complete search history.

(56) References Cited

U.S. PATENT DOCUMENTS

| | | | |
|---|---|---|---|
| 1,876,063 | A | 9/1932 | Kronenberger |
| 1,960,279 | A | 5/1934 | Read |
| 1,967,026 | A | 7/1934 | Gray et al. |
| D155,932 | S | 11/1949 | Shepard |
| D160,738 | S | 10/1950 | Randall |
| 2,766,660 | A | 10/1956 | Laddon et al. |
| 2,783,879 | A | 3/1957 | Emery |
| 2,863,595 | A | 12/1958 | Emery |
| 2,936,922 | A | 5/1960 | Williams |
| 3,261,531 | A | 7/1966 | Barth |
| 3,272,371 | A | 9/1966 | Weiner |
| 3,286,833 | A | 11/1966 | Chadbourne |
| 3,372,812 | A | 3/1968 | Parcels |
| 3,589,511 | A | 6/1971 | Britt |
| 3,591,032 | A | 7/1971 | Baxter |

(Continued)

FOREIGN PATENT DOCUMENTS

| | | |
|---|---|---|
| EP | 0330 090 | 8/1989 |

(Continued)

OTHER PUBLICATIONS

Stakker Roll Packaging System, Advertising Flyer, Aug. 1, 1995, Henry Molded Products Inc., 71 North 176th Street, Lebanon, PA 17046.

(Continued)

*Primary Examiner*—John A. Ricci
(74) *Attorney, Agent, or Firm*—R. Reams Goodloe, Jr.

(57) ABSTRACT

A support apparatus for receiving and supporting stacked tiers of bottles, particularly wine bottles. The support apparatus is (a) located below a first tier of layers of wine bottles, (b) placed between tiers of bottles, in case of multiple layers of bottles, and (c) secured above a top tier of layers of bottles, all to provide a stacked and secured arrangement of bottles that is suited for storage or transport. The support apparatus is preferably formed from a resinous plastic, polymeric material, such as PET. A multiple of the bottle supports combine to support a multiple layers of bottles in a tiered array. The bottle supports are manufactured in thin, nestable configurations, and are stored with a small, compact nested stack height.

69 Claims, 15 Drawing Sheets

U.S. PATENT DOCUMENTS

| | | | | |
|---|---|---|---|---|
| 3,608,706 | A | 9/1971 | Vigue | |
| 3,715,853 | A | 2/1973 | Bemiss | |
| 3,732,976 | A | 5/1973 | Bessett et al. | |
| 3,782,582 | A | 1/1974 | Lybbert et al. | |
| 4,195,732 | A | 4/1980 | Bell | |
| 4,241,830 | A | 12/1980 | Di Gesu | |
| 4,298,156 | A | 11/1981 | Reifers et al. | |
| 4,341,308 | A * | 7/1982 | Pasquini | 206/427 |
| 4,378,923 | A | 4/1983 | Takei | |
| 4,427,730 | A | 1/1984 | Robbins et al. | |
| 4,435,463 | A | 3/1984 | Roellchen | |
| 4,516,677 | A | 5/1985 | Roland et al. | |
| 4,610,362 | A | 9/1986 | Remp et al. | |
| 4,705,170 | A | 11/1987 | Creaden | |
| 4,792,045 | A | 12/1988 | Creaden | |
| 4,832,196 | A | 5/1989 | Butler | |
| 4,840,276 | A | 6/1989 | George | |
| 4,896,774 | A * | 1/1990 | Hammett et al. | 206/516 |
| 4,901,870 | A | 2/1990 | Wright et al. | |
| 4,936,453 | A | 6/1990 | Knitter | |
| 5,080,314 | A | 1/1992 | Moyer et al. | |
| 5,096,650 | A | 3/1992 | Renna | |
| 5,123,547 | A | 6/1992 | Koch | |
| 5,127,526 | A | 7/1992 | Vigue | |
| 5,161,703 | A | 11/1992 | Patton | |
| 5,259,508 | A | 11/1993 | Beckerman | |
| D345,845 | S | 4/1994 | Strzegowski, Jr. | |
| 5,335,770 | A | 8/1994 | Baker et al. | |
| 5,409,110 | A | 4/1995 | Patent | |
| 5,415,286 | A | 5/1995 | Marchek et al. | |
| 5,499,716 | A | 3/1996 | Gardner | |
| D381,180 | S | 7/1997 | Schueneman et al. | |
| 5,649,632 | A | 7/1997 | Terashima et al. | |
| D385,080 | S | 10/1997 | Schueneman et al. | |
| 5,755,541 | A | 5/1998 | Suarez | |
| D400,441 | S | 11/1998 | Warren | |
| D403,961 | S | 1/1999 | Warren | |
| D408,737 | S | 4/1999 | Warren, Jr. | |
| 5,899,331 | A | 5/1999 | Warren, Jr. | |
| 5,934,467 | A | 8/1999 | Gilfert et al. | |
| 6,026,958 | A | 2/2000 | Kelly et al. | |
| 6,142,300 | A | 11/2000 | Kelly et al. | |
| 6,142,440 | A | 11/2000 | Gratz et al. | |
| 6,321,911 | B1 * | 11/2001 | Raimer et al. | 206/509 |
| 6,322,034 | B1 | 11/2001 | O'Malley | |
| 6,474,613 | B2 | 11/2002 | O'Malley | |
| 6,705,469 | B2 * | 3/2004 | Slot | 206/587 |
| 6,820,743 | B2 * | 11/2004 | Hurley et al. | 206/427 |
| 2003/0070951 | A1 | 4/2003 | Hurley et al. | |

FOREIGN PATENT DOCUMENTS

| | | |
|---|---|---|
| FR | 1205747 | 2/1960 |
| FR | 2155005 | 5/1973 |
| GB | 0857011 | 12/1960 |
| GB | 0870704 | 6/1961 |
| IT | 0596274 | 7/1959 |
| IT | 0624839 | 9/1961 |
| WO | WO 00/76869 A1 | 12/2000 |

OTHER PUBLICATIONS

Abstract, No. 40390U-A, FR-2155005, Papeteries de Lumbres., Bottle Pack Trays, As Contoured Expanded Mouldings Which Positively Locate Alternating Rows and Layers of Bottles.; Apr. 10, 1971. (2 pages).

* cited by examiner

BOTTLE CRADLE STACKING SUPPORT

This application claims the benefit of U.S. Provisional Application(s) No(s).:

Application No.: 60/371,344 filed on Apr. 9, 2002.

RELATED PATENT APPLICATIONS

This invention is related to U.S. Provisional Patent Application Ser. No. 60/371,344, filed on Apr. 9, 2002, entitled Bottle Cradle Stacking Support, the disclosure of which is incorporated herein in its entirety, including the specification, drawing, and claims, by this reference.

COPYRIGHT RIGHTS IN THE DRAWING

A portion of the disclosure of this patent document contains material that is subject to copyright protection. The applicant no objection to the facsimile reproduction by anyone of the patent document or the patent disclosure, as it appears in the Patent and Trademark Office patent file or records, but otherwise reserves all copyright rights whatsoever.

TECHNICAL FIELD

The invention relates to cradles for stacking bottles, and more particularly to nestable stacking supports for bottles.

BACKGROUND

Bottles containing liquids, and in particular wine bottles, present a challenge to packers and shippers. Often today, bottles are shipped in cartons, with cardboard dividers between bottles to keep them from moving around and breaking against one another. Previously, wooden crates were often provided with appropriate retainers to constrain movement of the base of bottles, such as found in old soft drink cases designs. In other fields of endeavor, such as in the shipment of light bulbs or in the shipment of bottled water, various stacking supports have typically been employed.

Various materials and structures have been suggested, attempted, or actually used for receiving bottles and holding them for staking in horizontal layers. Some disclosures have suggested the use of a support and spacing member for bottles, formed from expanded polystyrene foam. However, certain characteristics of polystyrene foam make it less than ideal for use in bottle supports. This is because expanded polystyrene is rather rigid, relatively brittle, and thus has a minimum of structural flexibility. Additionally, polystyrene foam bottle cradle supports do not typically compactly nest together and thus storage of cradle supports manufactured of polystyrene or similar plastic materials usually takes up considerable space.

One alternative to polystyrene foam bottle cradles has been the development and use of bottle cradles made from papier-mâché. Unfortunately, in many circumstances, papier-mâché is inadequate for bottle cradles. For example, the strength of papier-mâché supports rapidly degrades when they get wet. Consequently, papier-mâché bottle cradles must be protected from the weather, and cannot be used in some humid environments. Such weather protection is especially difficult during transport, and requires that such bottle cradles be shipped within a fully enclosed container or trailer. Further, even though bottle cradles manufactured from papier-mâché have improved stackability over foam type supports, the papier-mâché bottle cradles must be of substantial thickness to support the weight of glass bottles and their contents, especially if many layers are desired.

Therefore, it can be appreciated that there still remains a need for an improved bottle cradle design which can be manufactured utilizing a material that would reduce the storage space requirements of bottle cradles, so as to free up warehouse space. And, there remains a need for a strong, weather-proof, preferably recyclable material which can be utilized in the production of compactly stackable bottle cradles.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawings, wherein.

In the various figures, it should be noted that the use of subscripts still generally refers to the structure so named without the subscript, but such subscripts are merely used for convenience in identifying similar structures in either uniformly stacked or back-to-back pairs of bottle supports, to distinguish similar structures in bottle supports formed and/or used together.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, various other elements of the bottle supports providing bottle cradles are also shown and briefly described to enable the reader to understand how various features, including optional or alternate features, may be utilized in order to provide a compact, efficiently nestable, reliable material structure for a bottle cradle stacking support.

DETAILED DESCRIPTION

Figure 8:
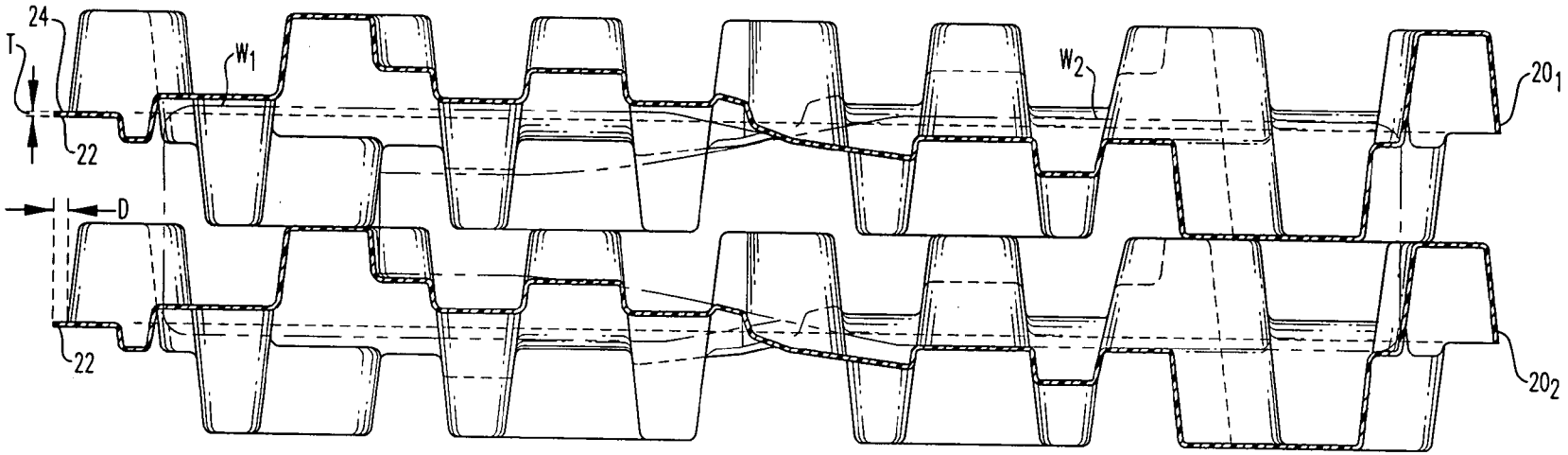
FIG. 8 is a vertical cross sectional view, similar to the view first shown in FIG. 5 above, but now showing an embodiment where a pair of bottle support apparati are stacked oriented in the same direction, cradle after cradle with the obverse side up, unlike the use of opposing pairs as shown in FIGS. 1 and 5.
Figure 9:
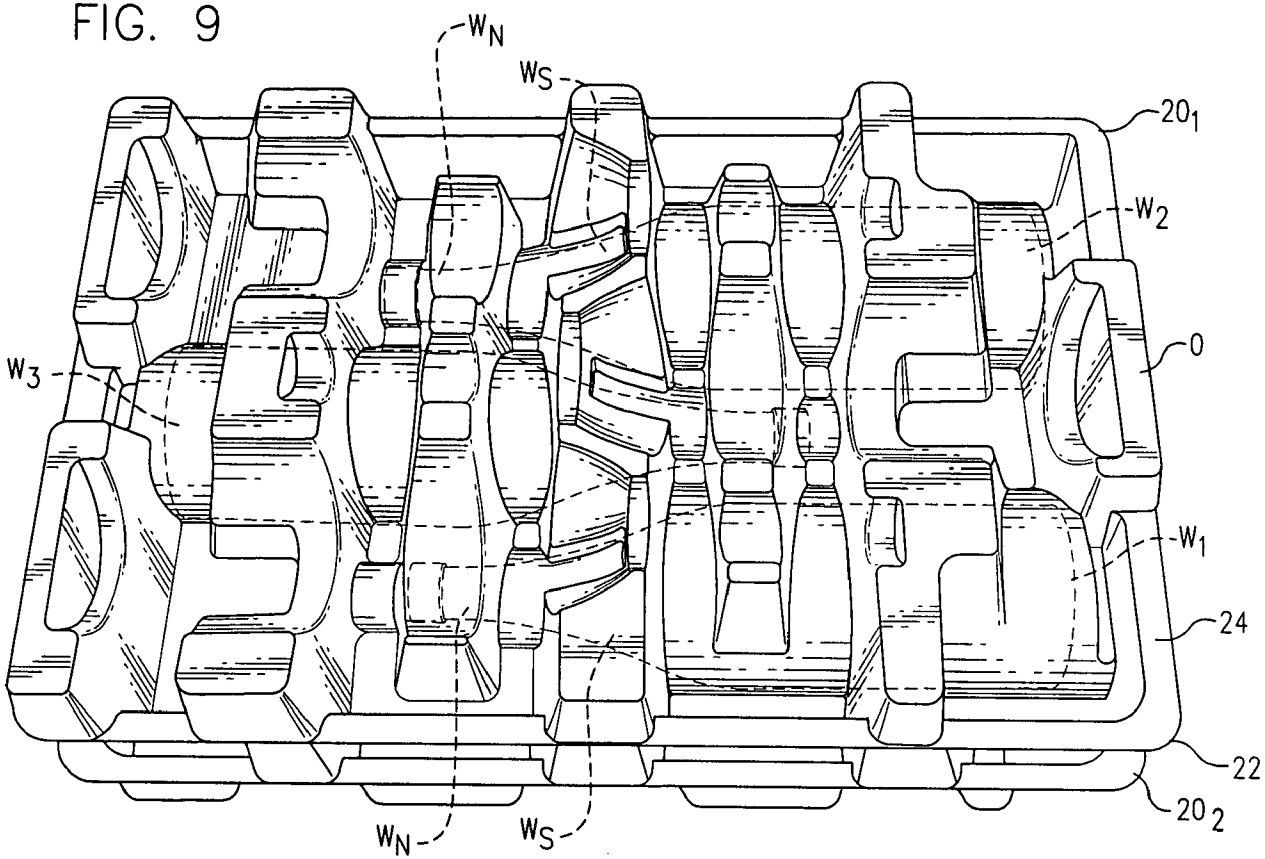
FIG. 9 is a top perspective view of a pair of bottle supports showing three wine bottles (in hidden lines) nested and secured therebetween, and also illustrating the use of thin, translucent or see-through bottle supports.

Attention is now directed to FIG. 9, wherein perspective view of one embodiment of an improved, bottle support apparatus 20 is illustrated. More specifically, an upper bottle support apparatus 201 having the obverse side O up is provided. Thus, the reverse side R of the support apparatus $\mathbf{20}_1$ is facing downward and contacting wine bottles $W_1$, $W_2$ and $W_3$. As shown in FIG. 8, the bottle support apparatus $\mathbf{20}_1$ has a perimeter match layer 22 of preselected thickness T. To maximize stackability of a bottle support apparatus 20, it is preferred that the thickness T be about 40 mils or less, and more preferably, that the thickness T be about 30 mils. The perimeter match layer 22 includes, extending along at least a portion thereof, a horizontal perimeter wall 24 extending inwardly for a preselectd distance D (see FIG. 4, for another example). As is also clear in FIG. 4, the obverse side O has a plurality of bottle cradle portions $\mathbf{30}_1$, $\mathbf{30}_2$, and $\mathbf{30}_3$. Each of the bottle cradle portions $\mathbf{30}_1$, $\mathbf{30}_2$, and $\mathbf{30}_3$ (identified by reference to the longitudinal centerline along each) has a first outward surface ($\mathbf{32}_1$, $\mathbf{32}_2$, and $\mathbf{32}_3$ shown), shaped in an arcuate segment of pre-selected dimensions adapted for securely receiving a first segment of a first wine bottle $W_1$ of substantially complementary shape. Also, the bottle cradle portions $\mathbf{30}_1$, $\mathbf{30}_2$, and $\mathbf{30}_3$ each have a first bottle bottom receiver $\mathbf{34}_1$, $\mathbf{34}_2$, $\mathbf{34}_3$, et cetera. The bottle support 20 also includes a plurality of obverse exterior foot portions 36. The obverse exterior foot portions ($\mathbf{36}_1$, $\mathbf{36}_2$, $\mathbf{36}_3$, $\mathbf{36}_3$, $\mathbf{36}_4$, $\mathbf{36}_5$, $\mathbf{36}_6$, $\mathbf{36}_7$, $\mathbf{36}_8$, and $\mathbf{36}_9$) extend upwardly above the horizontal perimeter wall 24 for a preselected distance H, and each has a corresponding upper pad portion $\mathbf{40}_1$, $\mathbf{40}_2$, $\mathbf{40}_3$, et cetera. The obverse exterior foot portions ($\mathbf{36}_1$, $\mathbf{36}_2$, $\mathbf{36}_3$, $\mathbf{36}_4$, $\mathbf{36}_5$, $\mathbf{36}_6$, $\mathbf{36}_7$, $\mathbf{36}_8$, and $\mathbf{36}_9$) each have an outer sidewall portion ($\mathbf{42}_1$, $\mathbf{42}_2$, $\mathbf{42}_3$, $\mathbf{42}_4$, $\mathbf{42}_5$, $\mathbf{42}_6$, $\mathbf{42}_7$, $\mathbf{42}_8$, and $\mathbf{42}_9$, respectively) which slopes inwardly and upwardly toward its companion upper pad portion $\mathbf{40}_1$, $\mathbf{40}_2$, $\mathbf{40}_3$, $\mathbf{40}_4$, $\mathbf{40}_5$, $\mathbf{40}_6$, $\mathbf{40}_7$, $\mathbf{40}_8$, and $\mathbf{40}_9$ respectively.

On the obverse side O of the bottle supports 20, each of the plurality of bottle cradle portions further have, situated along respective common longitudinal axes with the first outward surfaces $\mathbf{32}_1$, $\mathbf{32}_2$, and $\mathbf{32}_3$, a second outward surface $\mathbf{44}_1$, $\mathbf{44}_2$, and $\mathbf{44}_3$, shaped in an arcuate segment of pre-selected dimensions adapted for securely receiving a second segment of a bottle ($W_1$, $W_2$, or $W_3$, respectively) of substantially complementary shape.

Also on the obverse side O of the bottle supports 20, each of the plurality of bottle cradle portions further have, situated along respective common longitudinal axes with the first outward surfaces $\mathbf{32}_1$, $\mathbf{32}_2$, and $\mathbf{32}_3$, a third outward surface $\mathbf{46}_1$, $\mathbf{46}_2$, and $\mathbf{46}_3$, shaped in an arcuate segment of pre-selected dimensions adapted for securely receiving a neck $W_N$ Of wine bottle ($W_1$, $W_2$, or $W_3$, respectively) of substantially complementary shape.

For enhancing security of the bottles $W_1$, $W_2$, and $W_3$, on the obverse side O of bottle supports 20 has on each bottle cradle portion a fourth outward surface $\mathbf{48}_1$, $\mathbf{48}_2$, and $\mathbf{48}_3$, each of which is shaped as a portion of a surface of revolution of decreasing radius along the common longitudinal axis of that particular bottle cradle portion. The fourth outward surfaces $\mathbf{48}_1$, $\mathbf{48}_2$, are $\mathbf{48}_3$ of complementary size and shape to a shoulder portion $W_S$ of a bottle being secured in that particular bottle cradle portion, and the fourth outward surface is adapted to prevent movement of the relevant bottle ($W_1$, $W_2$, or $W_3$) toward the respective third surface $\mathbf{46}_1$, $\mathbf{46}_2$, or $\mathbf{46}_3$, along the common longitudinal axis of the particular bottle cradle portion.

Also to prevent movement of the relevant bottle ($W_1$, $W_2$, or $W_3$) toward the top 60 or bottom 62 of the bottle support 20 (as appropriate, but toward the top $W_T$ of the relevant wine bottle ($W_1$, $W_2$, or $W_3$), each of the bottle cradle portions in the obverse side is further provided with a bottle top stop $\mathbf{62}_1$, $\mathbf{62}_2$, or $\mathbf{62}_3$. Each bottle top stop $\mathbf{62}_1$, $\mathbf{62}_2$, or $\mathbf{62}_3$ is sized and shaped complementary to the top $W_T$ of the bottle and adapted to prevent the bottle ($W_1$, $W_2$, or $W_3$)

from moving toward the bottle top stop $62_1$, $62_2$, or $62_3$ as appropriate along the relevant common longitudinal axis.

For convenience, and ease of packing, I have provided one exemplary embodiment of a support apparatus 20 wherein the obverse side of the apparatus 20 has three bottle cradle portions. In such a configuration, the fourth outward surface $48_1$ in a first one $30_1$ of the three bottle cradle portions and the fourth outward surface $48_2$ in a second one $30_2$ of the three bottle cradle portions can be provided back-to-back on opposing sides of a wedge shaped foot 70 having an upper pad portion 72

The first outward surface $32_1$ of the first bottle cradle portion $30_1$ has a first interior side portion $76_1$, and wherein said first outward surface $32_2$ of the second bottle cradle portion $30_2$ has a second interior side portion $76_2$, and wherein the first $76_1$ and said second $76_2$ interior side portions have formed therebetween a central internal foot 80 having a top pad portion 82. The central internal foot 80 further includes an internal bottle top stop $62_3$, which is sized and shaped complementary to the top $W_T$ top of a bottle $W_3$ adapted to fit into the third bottle cradle portion $30_3$. The internal bottle top stop $62_3$ is adapted to prevent a bottle $W_3$ in the third bottle cradle $30_3$ from moving toward the bottle top stop $62_3$ along its longitudinal axis. Also, in the other bottle cradle portions, the bottle top stops $62_1$ and $62_2$ are commonly formed with and amounts to a cutout from the upper pad portion $84_3$ and $84_5$ of the obverse exterior foot portions $40_3$ an $40_5$.

Figure 4:
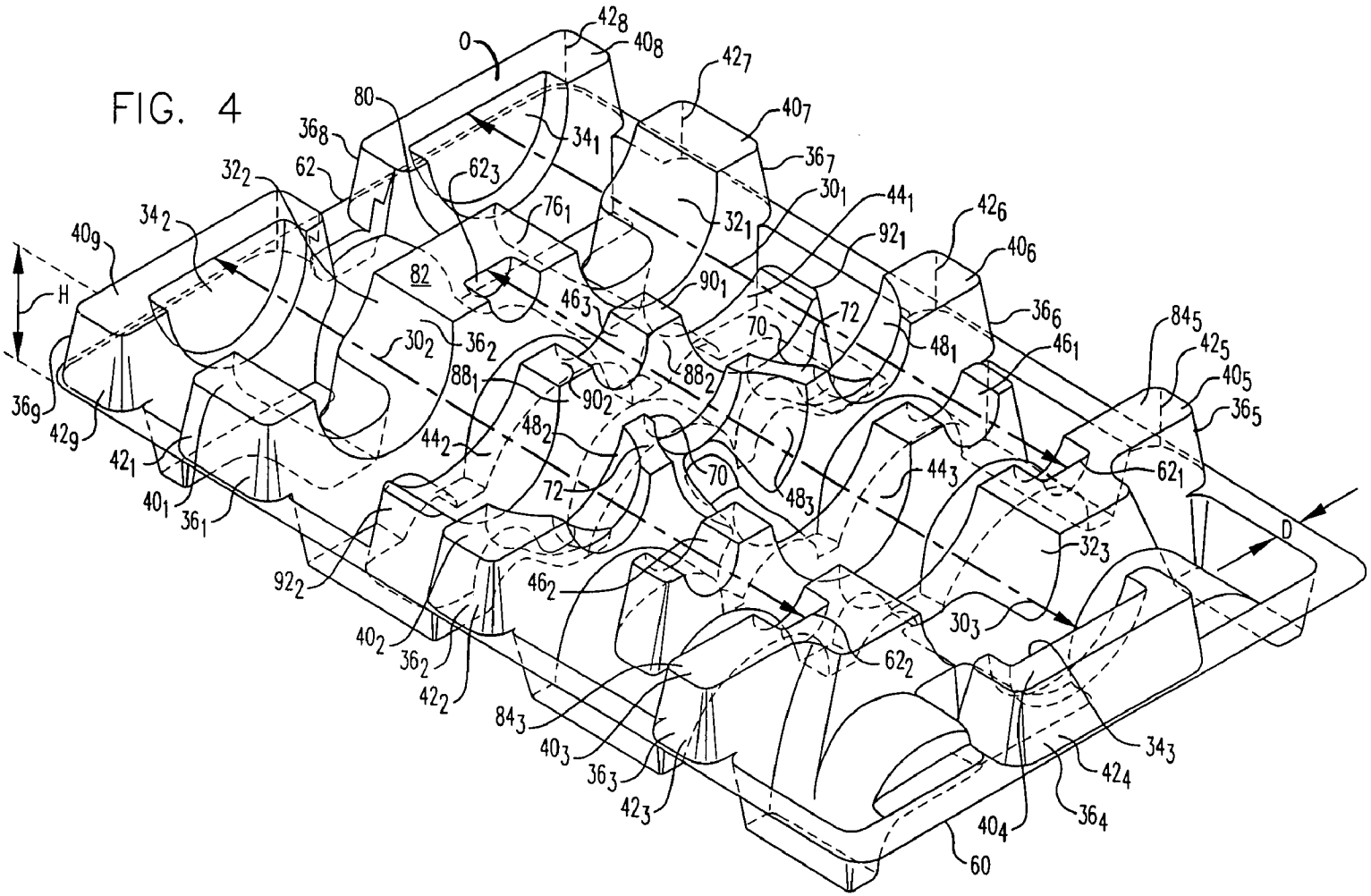
FIG. 4 is a perspective view of the obverse side O of the bottle support apparatus just shown in FIGS. 2 and 3, and also showing in hidden lines the features on the reverse side of the support apparatus.
Figure 5:
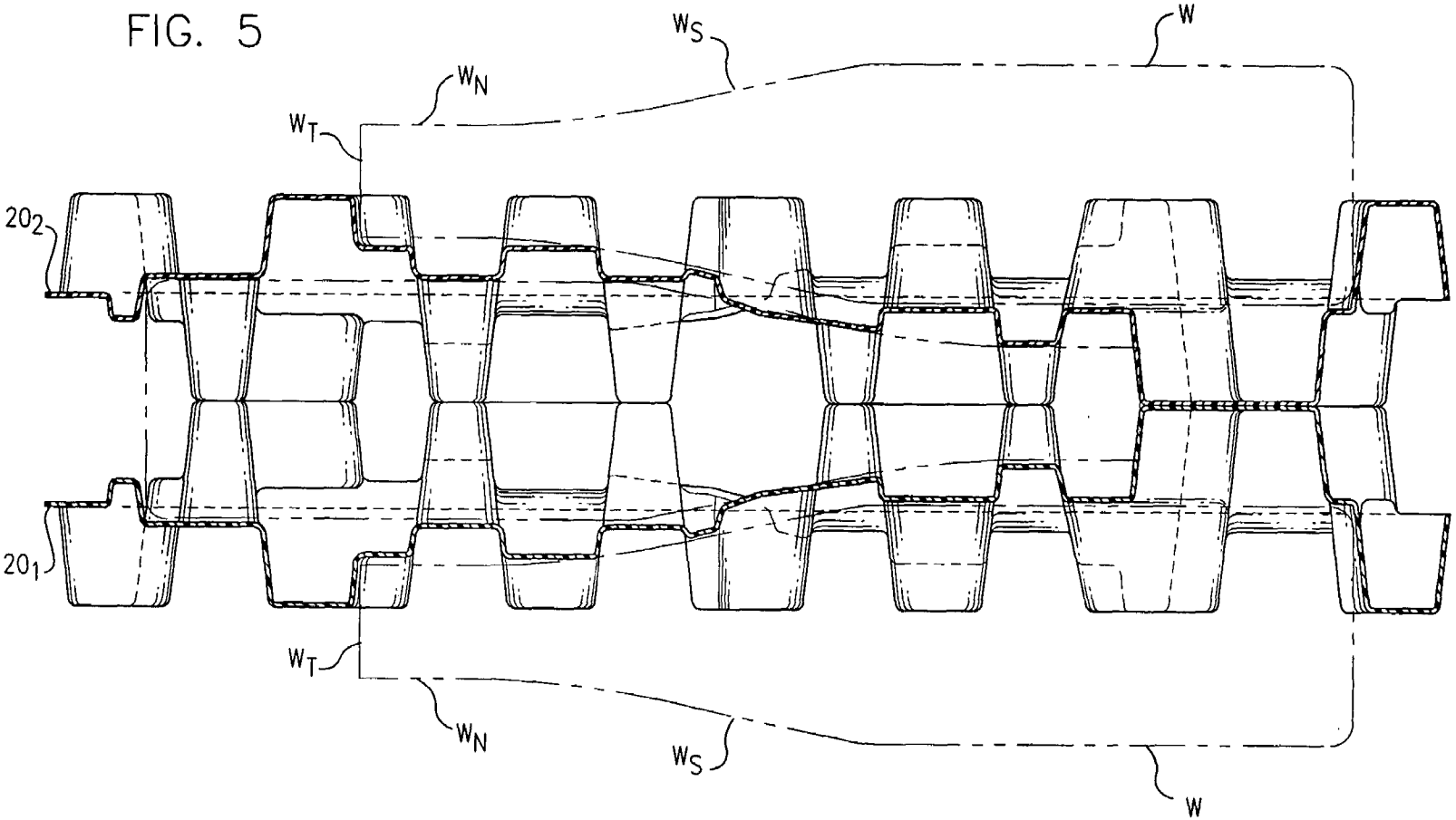
FIG. 5 is a vertical cross sectional view, illustrating the shape of opposing bottle supports when matched and utilized in the reverse side to reverse side configuration, and also showing in hidden lines a plurality of wine bottles secured thereby.
Figure 6:
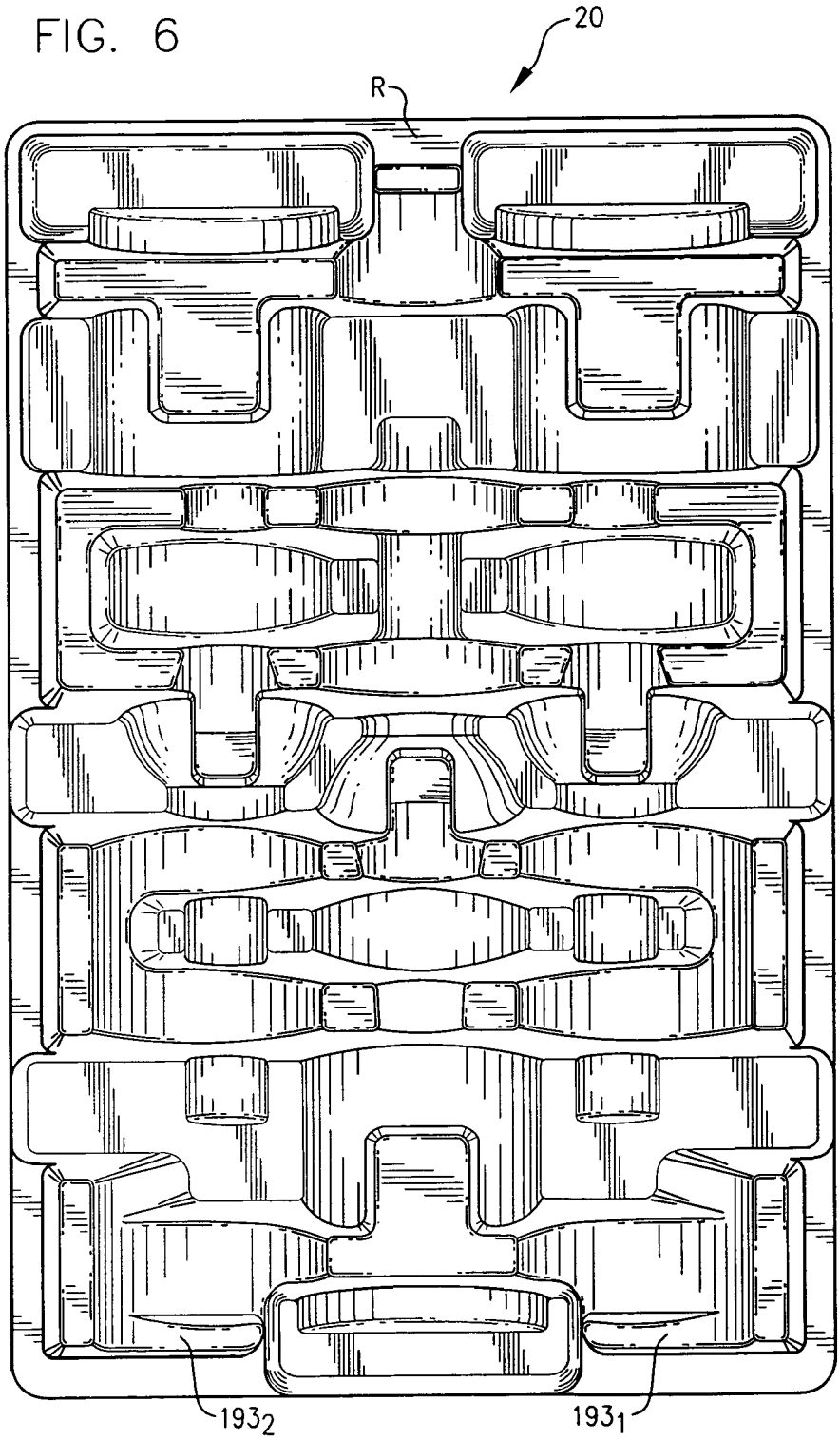
FIG. 6 is a bottom plan view of a bottle support apparatus, taken looking up at the reverse side of a bottle support apparatus, showing the provision of three bottle cradle portions for the support of three wine bottles.

The support apparatus 20 also has provided on the first bottle cradle portion $30_1$ and on the second bottle cradle portion $30_2$ on opposing sides of and supporting the second outward surfaces $44_1$ and $44_2$, at least one interior foot portion $88_1$ or $88_2$, respectively, each of which has a pad portion $90_1$ or $90_2$, respectively. As shown in FIG. 4, the interior foot portions $88_1$ and $88_2$ commonly supports a third outward surface $46_3$ in a third bottle cradle portion $30_3$. Note that the third outward surface $46_3$ is shaped in an arcuate segment of preselected dimensions adapted for securely receiving a neck $W_N$ portion of a bottle $W_3$ of substantially complementary shape.

Also, as seen in FIG. 4, the first bottle bottom receivers $34_1$, $34_2$, and $34_3$ are each carved out from, and formed by, one of the obverse exterior foot portions, $40_4$, $40_8$ or $40_9$, respectively.

Due to the double sided construction of the bottle supports $20_1$ each of the bottle cradle portions $30_1$ and $30_2$ has, situated along with the second outward surface $44_1$ and $44_2$, an interior support foot $92_1$ and $92_2$, respectively.

Figure 3:
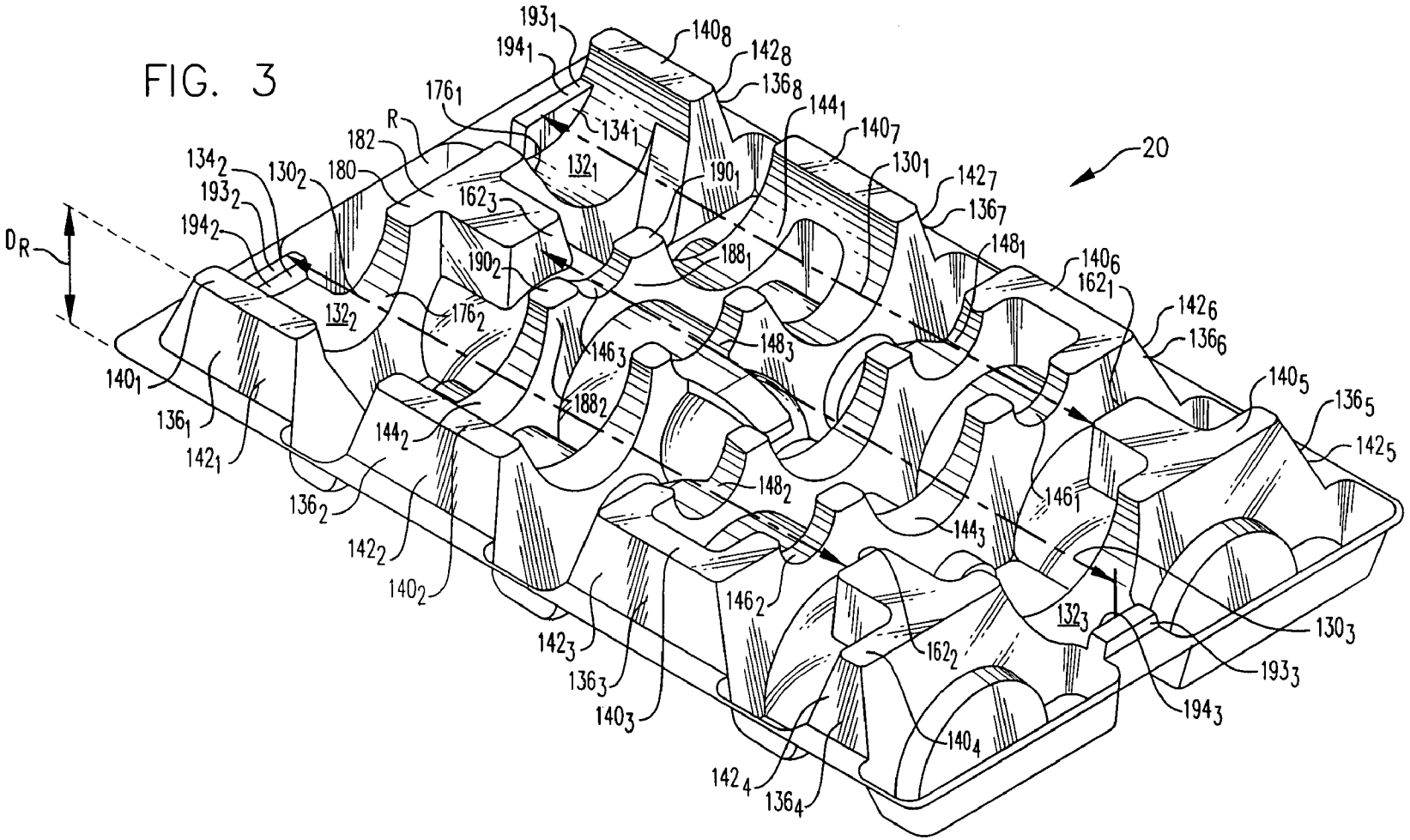
FIG. 3 is a perspective view of the reverse side R of one embodiment of a bottle support apparatus, showing in detail the various bottle cradle features provided for securely receiving bottles.

Turning now to FIG. 3, the reverse side R of a bottle support apparatus 20 is illustrated. The reverse side R has a plurality of bottle cradle portions $130_1$, $130_2$ and $130_3$, as indicated by reference numerals affixed to lines indicating a longitudinal axis of each. Each of the bottle cradle portions one the reverse side R has a first outward surface $132_1$, $132_2$, and $132_3$, respectively, shaped in an arcuate segment of pre-selected dimensions adapted for securely receiving a first segment of a first bottle $W_1$ of substantially complementary shape. First $134_1$ and second $134_2$ bottle bottom end stops are provided to secure the bottom WB of the respective bottle.

A plurality of reverse exterior foot portions $136_1$, $136_2$, et cetera through $136_8$ are provided. The reverse exterior foot portions extend downwardly below the horizontal perimeter wall 22 for a preselected distance $D_R$. Each of the reverse exterior foot portions have a lower pad portion $140_1$, $140_2$, $140_3$, et cetera, through $140_8$. Also, each of the reverse exterior foot portions has an outer sidewall portion $142_1$, $142_2$, et cetera through $142_8$, sloping inwardly and downwardly toward its companion lower pad portion.

To assist in the support of bottles W, in each of the plurality of bottle cradle portions $130_1$, $130_2$, and $130_3$, further comprises, situated along a common longitudinal axis with the first outward surface $132_1$, $132_2$, and $132_3$, a second outward surface shaped $144_1$, $144_2$, and $144_3$, respectively, in an arcuate segment of pre-selected dimensions adapted for securely receiving a second segment of said bottle W of substantially complementary shape.

Additionally, each of the plurality of bottle cradle portions on the reverse side of bottle support 20 further comprises, situated along the respective common longitudinal axis, a third outward surface $146_1$, $146_2$ and $146_3$ shaped in an arcuate segment of preselected dimensions adapted for securely receiving a neck portion $W_N$ of a bottle W of substantially complementary shape.

In between the second outward surface and the third outward surface in each of the bottle cradle portions on the reverse side R of bottle support $20_1$ and situated along the respective common axis, is a fourth outward surface $148_1$, $148_2$, and $148_3$ comprising a portion of a surface of revolution of decreasing radius along the respective common longitudinal axis. The fourth outward surface is of complementary size and shape to a shoulder portion $W_S$ of a bottle W and is adapted to prevent movement of the bottle toward the respective third surface along the respective common longitudinal axis.

At the end of each of the respective common longitudinal axes, a bottle top stop $162_1$, $162_2$, and $162_3$, respectively, is provided. Each bottle top stop is sized and shaped complementary to the top $W_T$ of a bottle W and adapted to prevent the bottle from moving past the bottle top stop along the respective common longitudinal axis.

As depicted in the embodiment shown in FIG. 3, the reverse side R has three bottle cradle portions. In such an arrangement, it is possible to provide a configuration wherein a fourth outward surface of a first one of the three bottle cradle portions and a fourth outward surface of a second one of the three bottle cradle portions are provided back-to-back on opposing sides of a wedge shaped foot having an upper pad portion.

Also, first outward surface of a first bottle cradle portion has a first interior side portion $176_1$, and the first outward surface of a second bottle cradle portion has a second interior side portion $176_2$, so that the first and second interior side portions have formed therebetween a central internal foot 180 having a top pad portion 182. As already noted, the internal foot 180 has an internal bottle top stop $162_3$. The internal bottle top stop is sized and shaped complementary to the top of a bottle adapted to fit into said third bottle cradle portion, so that the internal bottle top stop is adapted to prevent a bottle W in the third bottle cradle $130_3$ from moving past the bottle top stop along its longitudinal axis.

On opposing sides of and supporting the second outward surface $144_1$ and $144_2$ is at least one interior foot portion $188_1$ and/or $188_2$, which interior foot portion has a pad portion $190_1$ or $190_2$, respectively. Ideally, and as noted in FIG. 3, the at least one interior foot portion between the first and third bottle cradle portions commonly supports a third outward surface $146_3$ in a third bottle cradle portion $130_3$. The third outward surface $146_3$ is shaped in an arcuate segment of preselected dimensions adapted for securely receiving a neck portion $W_N$ of a bottle of substantially complementary shape.

In the reverse side R, extending down from the top end 60 and/or upward from the bottom end 62 are one or more lateral foot portions 193$_1$, 193$_2$, and 193$_3$, each having an interior surface portion 194$_1$, 194$_2$, or 194$_3$, respectively. In each bottle cradle portion, the first bottle bottom stop is raised up from, and formed by an interior surface of, one of the lateral foot portions.

The at least one interior foot portion in a first bottle cradle portion in each of the plurality of bottle cradle portions in the reverse side commonly supports a third outward surface in a second bottle cradle portion. The third outward surface is shaped in an arcuate segment of preselected dimensions adapted for securely receiving a portion of a bottle of substantially complementary shape.

Generally, bottles are provided in cylindrical barrels lower portions, so in such cases, the outward surfaces in the obverse side comprises an arcuate segment of a circle, up to a maximum of a generally semi-circular shape.

For stackability note the various foot portions, such as the obverse exterior foot portions, are angled inward at an angle sigma ($\Sigma$), such as about 20 degrees, with respect to a plane perpendicular to the horizontal perimeter wall. Likewise, on the reverse exterior foot portions, the portions are angled inward at an angle beta ($\beta$), such as at about 20 degrees, with respect to a plane perpendicular to the horizontal perimeter wall.

Figure 7:
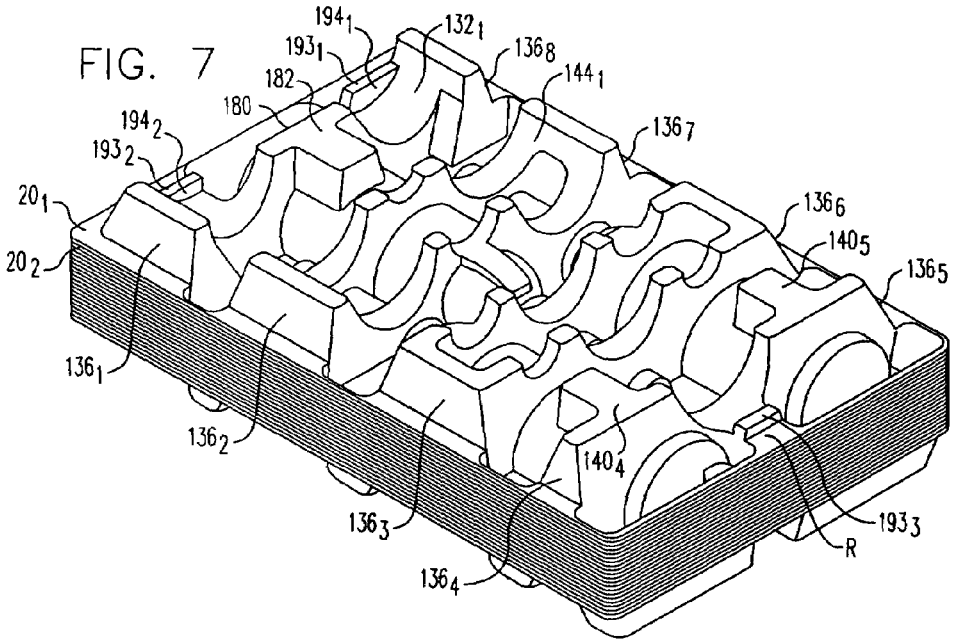
FIG. 7 is a perspective view of a plurality of bottle support apparati nested (reverse side up) for shipment, showing the compact configuration which allows a high bottle cradle density (total number of units) for a given storage volume.
Figure 10:
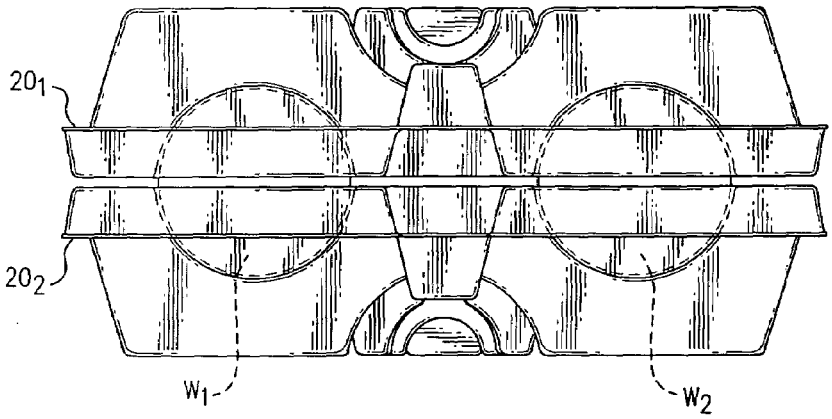
FIG. 10 is an end perspective view of a pair of bottle supports showing wine bottles nested and secured therebetween; the bottle supports are shown with the lower bottle support having the obverse side up, and with the upper bottle support having the obverse side down (reverse side up).

For compact shipment of stacked or nested bottle supports, as shown for example in FIG. 7, the horizontal wall, and similar thickness of each part, is sufficiently thin so that at least 16 support apparatus units are stackable in one inch of stacking height. More preferably, the base of the support apparatus is sufficiently thin so that at least 20 support apparatus units are stackable in one inch of stacking height. Even better, the base of the support apparatus is sufficiently thin so that at least 25 support apparatus units are stackable in one inch of stacking height. To achieve the desired stacking heights, the horizontal perimeter wall should be provided in a plastic material having a thickness of approximately 30 mils.

For customer appeal, one attractive feature seen in FIGS. 9 through 12 is that the support apparatus can be provided in a see-through or a translucent material. When using plastics, this material can be provided in a pleasant, light green see-through shade plastic material.

The bottle support apparatus can be manufactured from a strong, flexible plastic material. Suitable materials include polyethylene terephthalate. For ease of manufacturing, the support apparatus can be formed as a thermoformed solid. It is possible to manufacture the support apparatus out of recycled plastic material.

Figure 1:
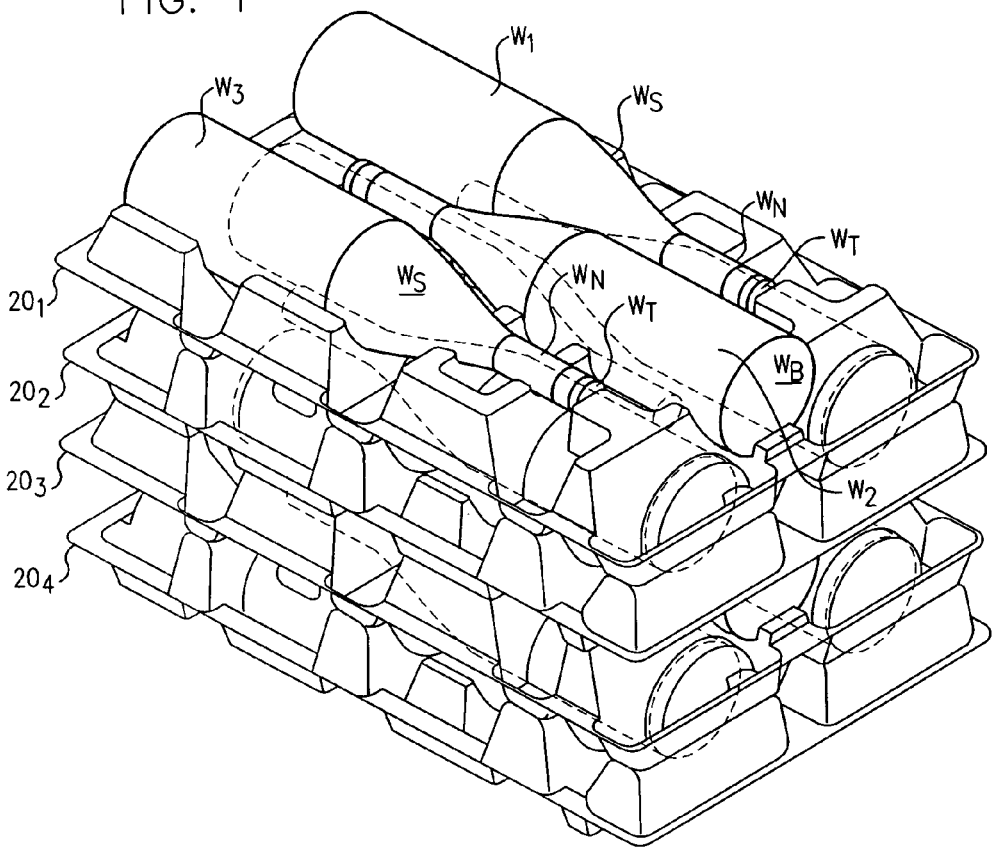
FIG. 1 is a perspective view of the combination of a plurality of bottle support apparatus and multiple layers of wine bottles, each support apparatus having a plurality of bottle cradles on the obverse side and on the reverse side, the plurality of support apparati shown in a working arrangement to support stacked layers of wine bottles, as might be placed into a box for shipment.
Figure 2:
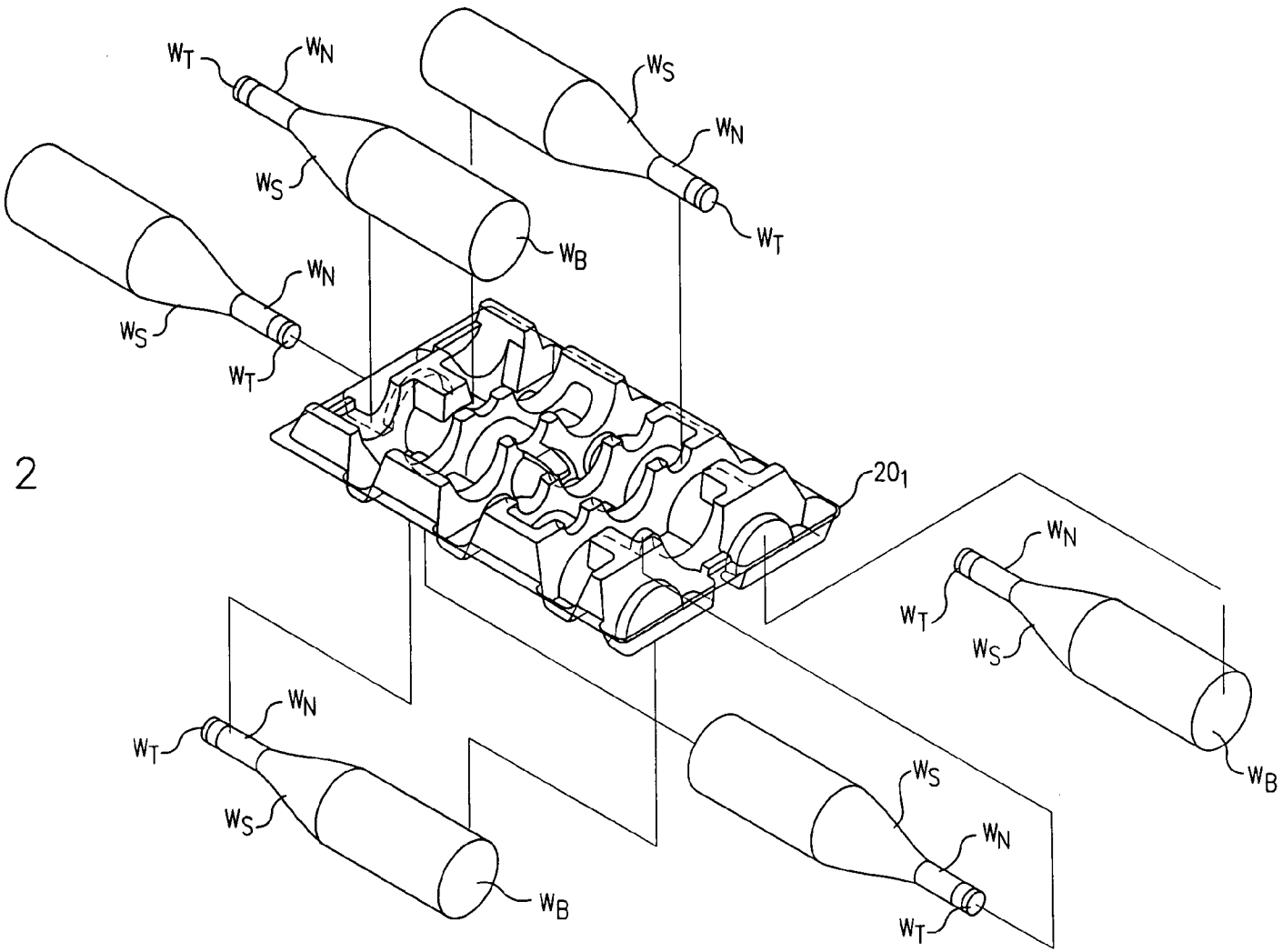
FIG. 2 is a perspective view of the reverse side of a bottle support apparatus, showing how the support apparatus has a plurality of bottle cradles on the reverse side, and a plurality of bottle cradles on the obverse side, showing how the bottle cradle disclosed herein utilizes a "double sided" feature to allow the nesting of bottles above and below a single support apparatus, where such a support apparatus would be situated intermediate to an upper and a lower support apparatus (not shown).

As first noted in FIG. 1, and as also shown in FIG. 2, in one embodiment, a feature of the stacking support provided hereby is the reversibility and flexibility for use in packaging a plurality of bottles. A first support layer comprising a support apparatus unit can be supplied having a support apparatus unit adapted for placement on a supporting substrate. The support apparatus unit supports thereon a 1st tier layer of bottles in a series of layers from 1 to N layers, wherein the 1st tier layer comprising multiple bottles such as the three bottles depicted herein. Then, a second support layer comprising a support apparatus unit is stacked on the 1st tier layer of bottles, to secure the 1st tier layer and to support a second tier layer of bottles. Then, additional support layers each comprising a support apparatus unit and an additional layer of bottles thereon is provided in a series of 1 to N layers. To complete a stack for packing and shipment, a final support apparatus unit is provided above an Nth and final layer of bottles. Although use of the support apparatus units is contemplated with filled bottles containing liquids such as wine, the support units can also be used to ship empty bottles.

Note also from the various figures and illustrations that many configurations are feasible with the unique configuration and design details of the support apparatus provided. For example, a first support apparatus can be oriented obverse side up, and a second, identical support apparatus can be oriented obverse side up, in a stack of N layers. Alternately, a first support apparatus can be oriented obverse side up, and a second, identical support apparatus can be oriented reverse side up in a stack of N layers. For maximizing internal support, support units can be matched so that a plurality of pads of the obverse support foot portions and a plurality of pads of the reverse support foot portions are matched in opposing fashion, so as to assist in the support of the weight of a combination including support units and N layers of bottles containing liquid, for example. In the just described scenario, it is also possible to add a third layer of support apparatus oriented with the obverse side up. Then, in such a stackup, a fourth support apparatus could be provided oriented reverse side up.

Alternately, a first support apparatus can be added oriented obverse side up, and a second, identical support apparatus can be added oriented obverse side up. Alternately, a first support apparatus can be oriented reverse side up, and a second support apparatus can be oriented obverse side up, so that a pair of reverse sides are brought together in mating engagement.

Figure 11:
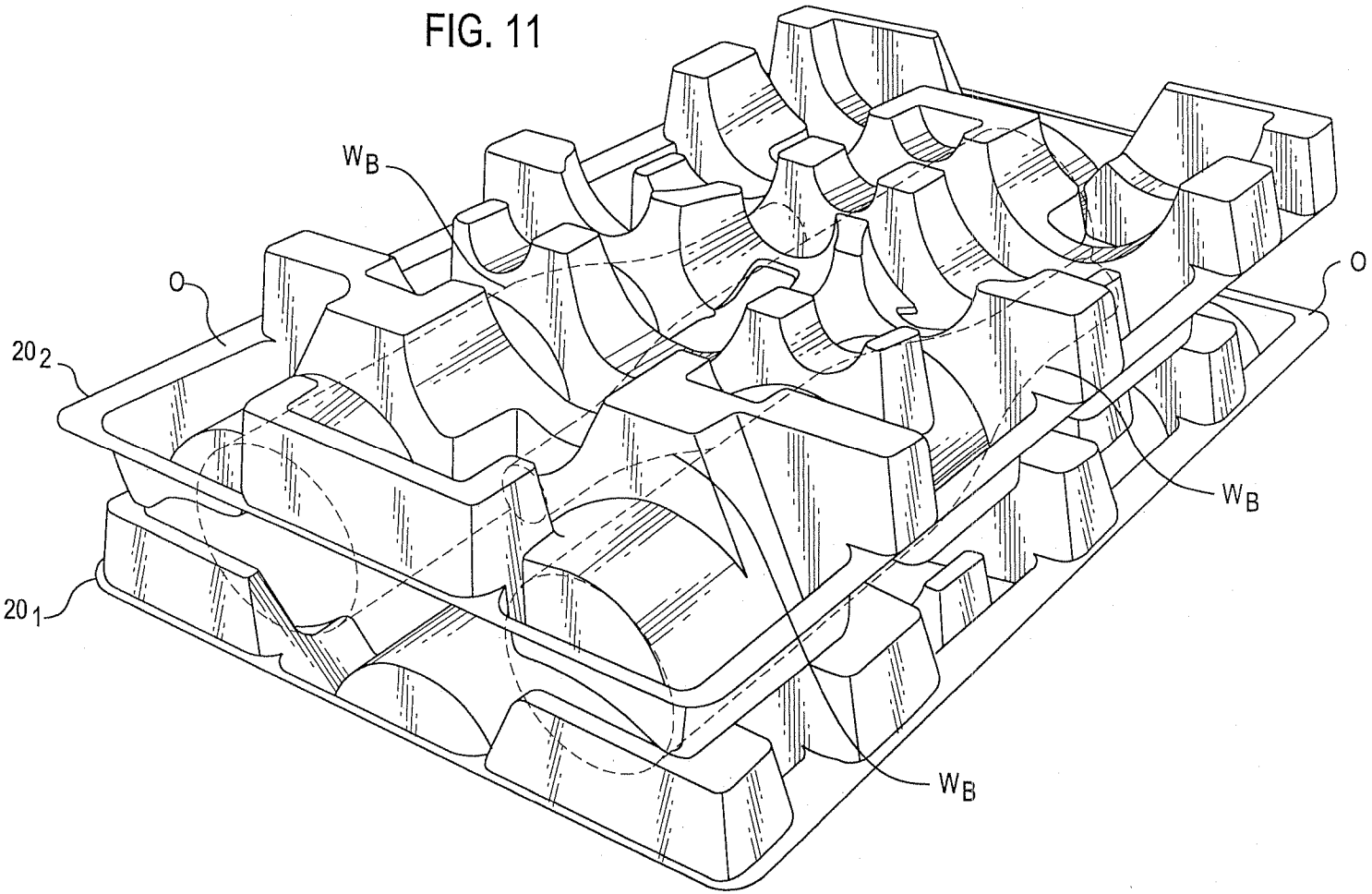
FIG. 11 is a side perspective drawing of a pair of bottle supports showing three wine bottles nested and secured therebetween, with the bottle supports oriented with a first (lower) support having the obverse side up, and the second (upper) support also having the obverse side up, but wherein the second (upper) bottle support is oriented 180 degrees from the first (lower) bottle support.

In FIG. 11, a side perspective drawing of a pair of bottle supports $20_1$ and $20_2$ are provided, showing three wine bottles $W_B$ nested and secured therebetween. The bottle supports $20_1$ and $20_2$ are oriented with a first (lower) support $20_1$ having the obverse O side up, and the second (upper) support $20_2$ also having the obverse O side up. However, the second (upper) bottle support $20_2$ is oriented 180 degrees from the first (lower) bottle support$20_1$. Thus, the versatility of the bottle supports described herein is clearly seen.

Figure 12:
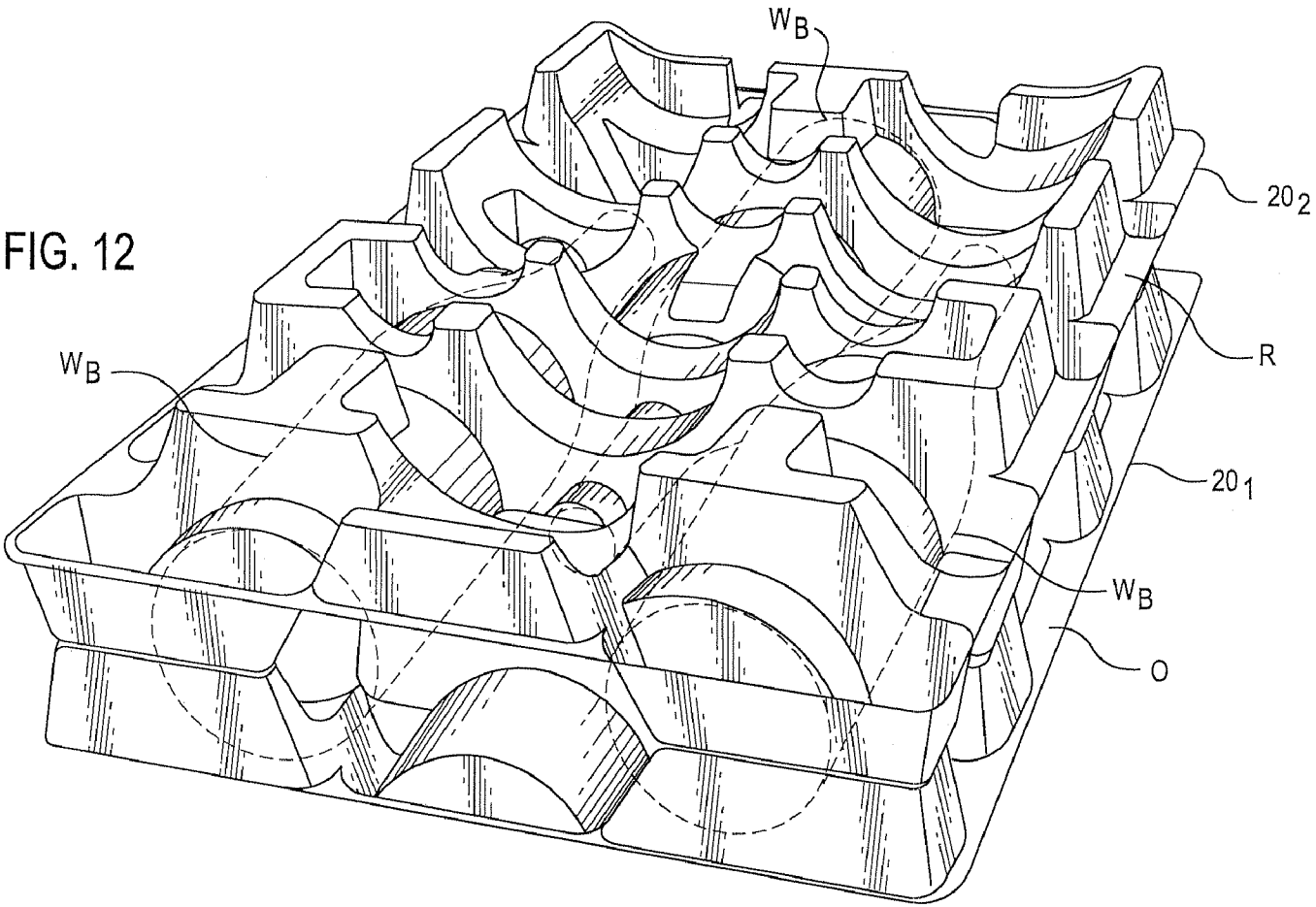
FIG. 12 is a side perspective drawing of a pair of bottle supports showing three wine bottles nested and secured therebetween, with the bottle supports oriented with a first (lower) support having the obverse side up, and the second (upper) support having the reverse side up (i.e, obverse side down).

Similarly, in FIG. 12, a side perspective drawing is provided of a pair of bottle supports $20_1$ and $20_2$ showing three wine bottles $W_B$ nested and secured therebetween. The bottle supports $20_1$ and $20_2$ are oriented with a first (lower) support $20_1$ having the obverse O side up, and with the second (upper) support $20_2$ having the reverse R side up (i.e., obverse O side down). Again, the versatility of the bottle supports provided herein is illustrated.

Figure 13:
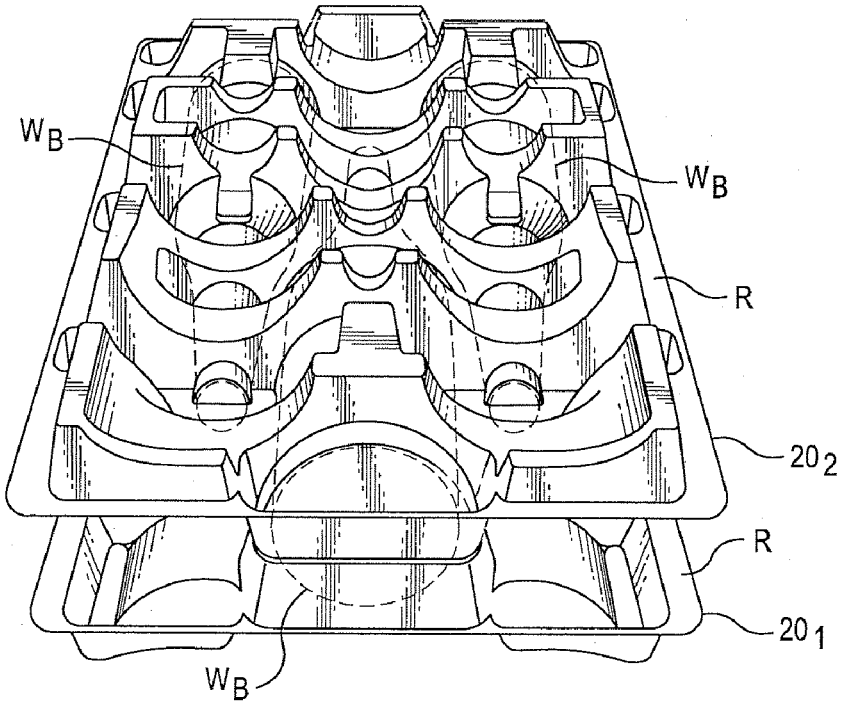
FIG. 13 is an end perspective drawing of a pair of bottle supports, showing three wine bottles nested and secured therebetween, with the bottle supports oriented with a first (lower) support having the reverse side up, and with the second (upper) support also having the reverse side up, but oriented 180 degrees from the first (lower) support.

Further, in FIG. 13 an end perspective drawing is provided of a pair of bottle supports $20_1$ and $20_2$. Here, three wine bottles $W_B$ are nested and secured therebetween. The bottle supports $20_1$ and $20_2$ are oriented with a first (lower) support $20_1$ having the reverse R side up, and with the second (upper) support $20_2$ also having the reverse R side up, but oriented 180 degrees from the first (lower) support $20_1$. Note how the translucent nature of the bottle supports, generally shown in this and other drawing figures provided, allow the packer or recipient to easily see the merchandise which is being protected by the support. This contrasts dramatically with, for example, prior art paper based stacking supports.

Figure 14:
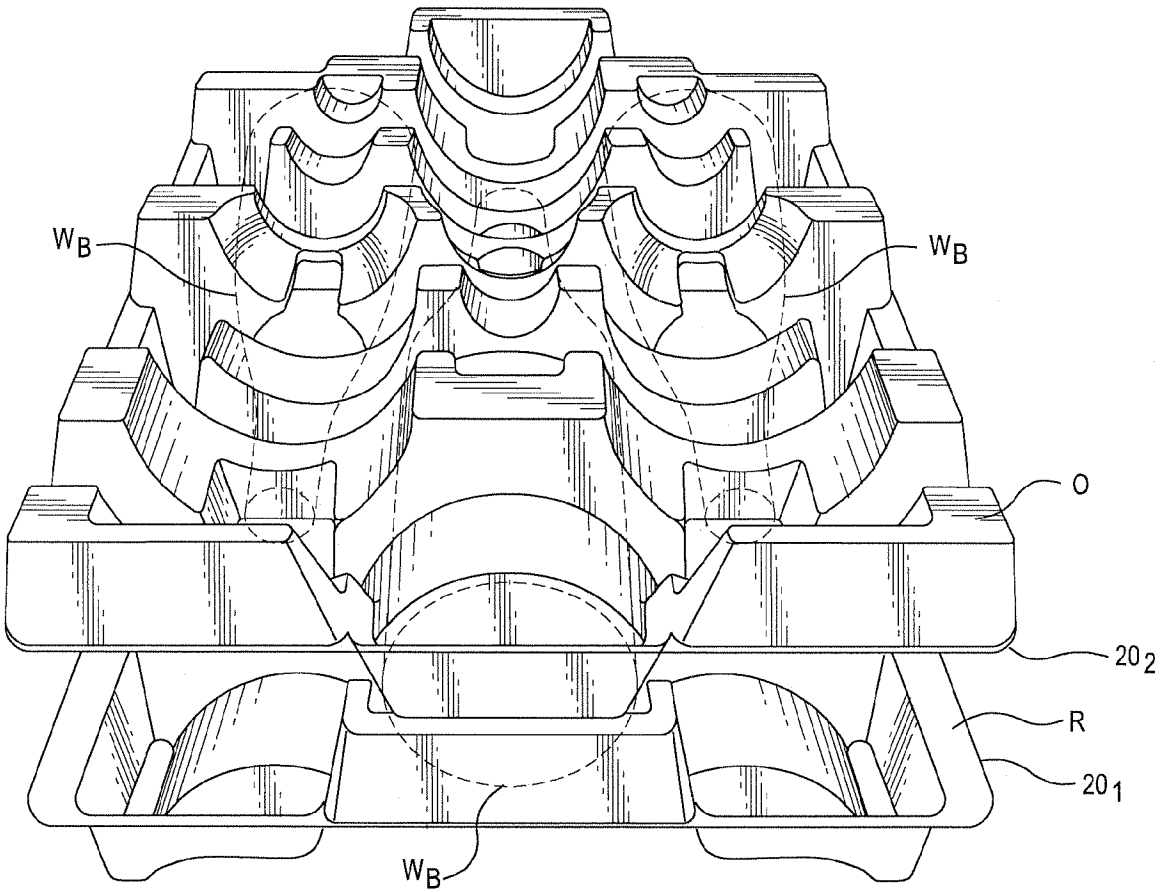
FIG. 14 is an end perspective drawing of a pair of bottle supports, showing three wine bottles nested and secured therebetween, with the bottle supports oriented with a first (lower) support having the reverse side up, and with the second (upper) support having the obverse side up.

In FIG. 14, an end perspective drawing figures of a pair of bottle supports $20_1$ and $20_2$ is shown. Here, three wine bottles $W_B$ nested and secured therebetween the bottle supports $20_1$ and $20_2$. The bottle supports are oriented with a first (lower) support $20_1$ having the reverse R side up, and with the second (upper) support $20_2$ having the obverse O side up.

Figure 15:
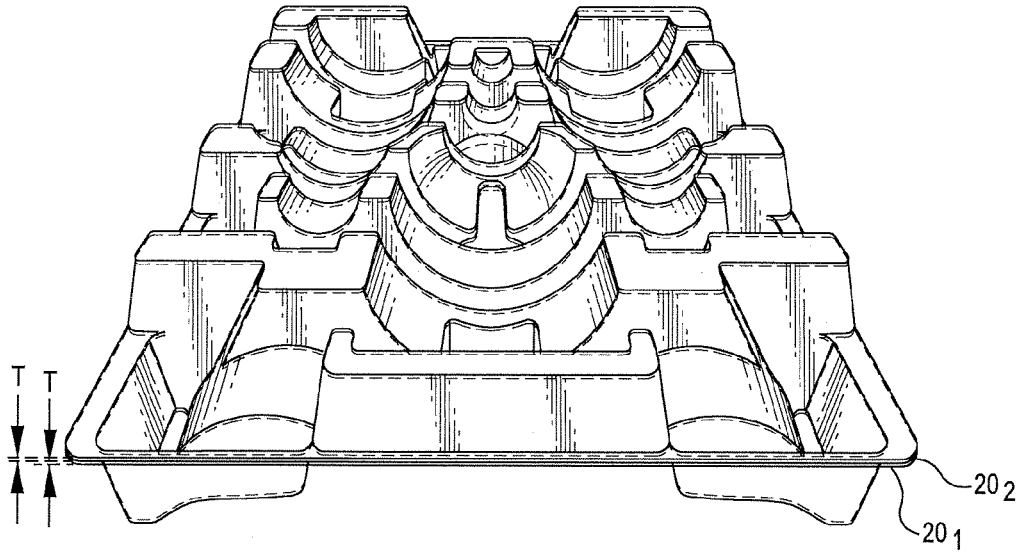
FIG. 15 is a perspective drawing of a pair of bottle supports nested together for storage or for shipping prior to use, illustrating (similar to FIG. 7) the compact stack which can be created due to the minimal thickness and the very compact stacking height provided by the bottle support design.

Attention is now directed to FIG. 15, where a perspective drawing of a pair of bottle supports $20_1$ and $20_2$ nested together for storage or for shipping prior to use is illustrated. Note the compact stack which can be created due to the minimal thickness and the very compact stacking height provided by the bottle support design.

Figure 16:
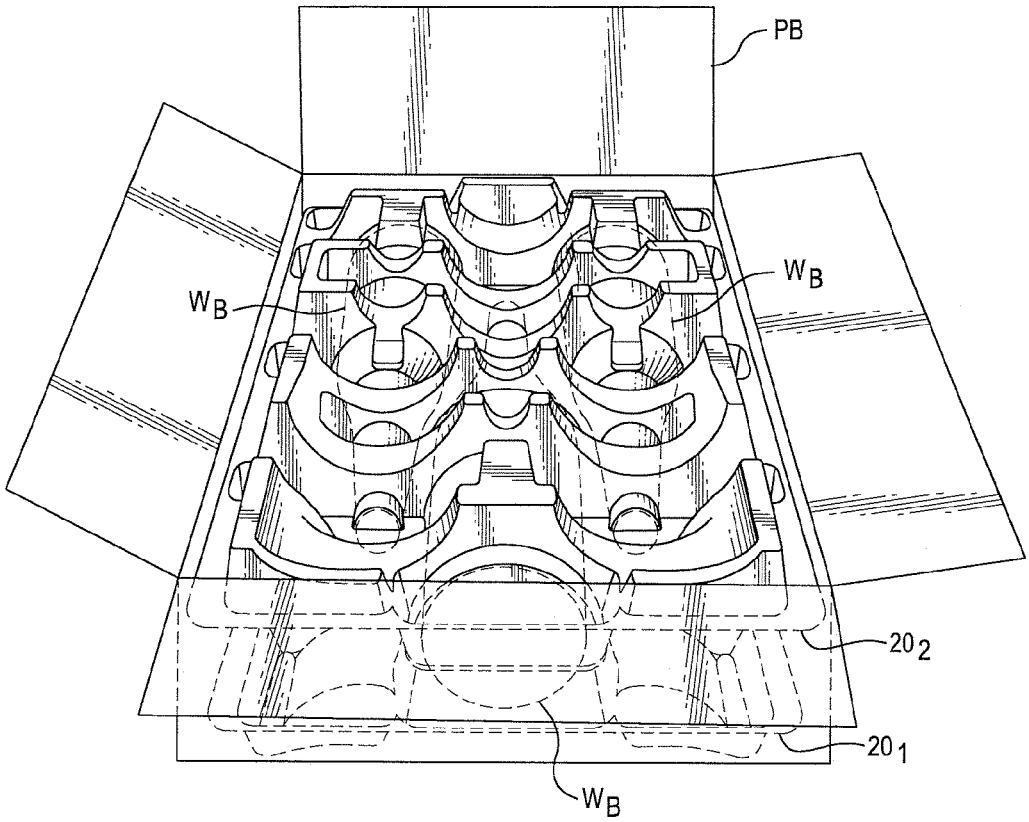
FIG. 16 is a perspective drawing of a pair bottle supports located in a box for shipping, showing three wine bottles nested and secured between a pair of bottle supports.

Finally, in FIG. 16, a perspective drawing of a pair bottle supports $20_1$ and $20_2$ is shown as located in a paperboard box PB for shipping, showing three wine bottles $W_B$ nested and secured between a pair of bottle supports $20_1$ and $20_2$.

With respect to materials for fabricating a bottle support, note that a cushioning support is desired when protecting a fragile article such as glass bottles, or glass light bulbs, or the like, yet supports described herein must be sufficiently strong and resistant to deformation. Such applications are ideal for PET, since PET resin forms a high strength product with good strength in all directions. Also, many businesses now prefer that materials be manufactured from recycled materials. The disclosed bottle cradle supports are easily fabricated from recycled plastic materials. Also, use of recycled plastic material is a great advantage over most prior art cellulose materials, since recycling of cellulose materials suitable for packaging supports is considered more complex and difficult than manufacture of plastic materials from recycled materials. In the manufacture of bottle cradles, suitable recycled plastics are relatively easy to reprocess. PET, as with a great variety of plastic materials, is initially segregated at time of disposal, after which it is typically kept clean and uniform during the entire recycling process. This process substantially enhances the likelihood of retaining desirable material properties in a finished bottle cradle support made from recycled materials.

As shown in FIGS. 7 and 16, another property which is provided by the use of PET is that paired supports 20 can easily stack over a previous pair with only a slight increase in height. As shown in FIG. 7, the thickness T of a support can be as little as from approximately 40 Mils to approximately 60 Mils (or from about 0.04 inches to about 0.06 inches). In one embodiment, the thickness T can be limited to not exceed the lower end of this range, or 40 Mils (0.040 inches). Thus, with such manufactured thickness, supports could be stacked from approximately 16 per inch, to about 20 per inch, and even up to as dense as about 26 per inch. Of course, it is desirable from a storage and nesting perspective that thicknesses be provided which occur at the lower end of the stated thickness range. This very small thickness, when nested, is a significant advantage over the stacked pairs of prior art papier-mâché material, since papier-mâché material prohibits such a close nested stacking of new or used supports. For example, about an eight to one advantage in stacking of PET supports is provided over commercially available fabricated in prior art papier-mâché materials. Thus, the nesting compactness of the present invention provides a substantial and significant savings in shipping and storage space, as compared to prior art papier-mâché or other foam or plastic materials. Thus, it is important to note that warehouse space saved in the storage of nested and still unused supports can be allotted to other storage needs. Alternatively, the saved storage or shipping space can be used to store or transport additional bottle supports and allow the purchase of higher quantities to realize bulk rate cost savings and substantially reduce freight costs.

It is to be appreciated that the various aspects and embodiments of the bottle cradle stacking supports as described herein are an important improvement in the state of the art of structures and materials for bottle cradle stacking supports. Although only a few exemplary embodiments have been described in detail, various details are sufficiently set forth in the drawings and in the specification provided herein to enable one of ordinary skill in the art to make and use the invention(s), which need not be further described by additional writing in this detailed description. Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention(s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

The invention claimed is:

1. A support apparatus for receiving and supporting bottles, said support apparatus comprising:

(a) a perimeter match layer of preselected thickness, said perimeter match layer having along at least a portion thereof a horizontal perimeter wall extending inwardly for a preselected distance;

(b) an obverse side, said obverse side comprising (i) a plurality of bottle cradle portions, said plurality of bottle cradle portions comprising at least two bottle cradle portions oriented in complementary opposing relationship along adjacent longitudinal centerlines, each of said bottle cradle portions comprising (A) a first outward surface shaped in an arcuate segment of preselected dimensions adapted for securely receiving a first segment of a first bottle of substantially complementary shape, (B) a first bottle bottom receiver, and (ii) a plurality of obverse exterior foot portions, said obverse exterior foot portions extending upwardly above said horizontal perimeter wall for a preselected distance and having an upper pad portion, said obverse exterior foot portions comprising an outer sidewall portion sloping inwardly and upwardly toward its companion upper pad portion;

(c) a reverse side, said reverse side comprising (i) a plurality of bottle cradle portions, each of said bottle cradle portions comprising (A) a first outward surface shaped in an arcuate segment of pre-selected dimensions adapted for securely receiving a first segment of a first bottle of substantially complementary shape, (B) a first bottle bottom end stop, and (ii) a plurality of reverse exterior foot portions, said reverse exterior foot portions extending downwardly below said horizontal perimeter wall for a preselected distance and having a lower pad portion, said reverse exterior foot portions comprising an outer sidewall portion sloping inwardly and downwardly toward its companion lower pad portion.

2. The support apparatus as set forth in claim 1, wherein each of said plurality of bottle cradle portions further comprises, situated along a common longitudinal axis with said first outward surface, a second outward surface shaped in an arcuate segment of pre-selected dimensions adapted for securely receiving a second segment of said bottle of substantially complementary shape.

3. The support apparatus as set forth in claim 2, wherein each of said plurality of bottle cradle portions further comprises, situated along said common longitudinal axis, a third outward surface shaped in an arcuate segment of preselected dimensions adapted for securely receiving a neck portion of a bottle of substantially complementary shape.

4. The support apparatus as set forth in claim 3, wherein each of said plurality of bottle cradle portions further comprises, along a common axis between said second outward surface and said third outward surface, a fourth outward surface comprising a portion of a surface of revolution of decreasing radius along said common longitudinal axis, said fourth outward surface of complementary size and shape to a shoulder portion of said bottle and adapted to prevent movement of said bottle toward said third surface along said common longitudinal axis.

5. The support apparatus as set forth in claim 4, wherein each of said plurality of bottle cradle portions further comprises, above said fourth outward surface along said common longitudinal axis, a bottle top stop, said bottle top stop sized and shaped complementary to the top of said bottle and adapted to prevent said bottle from moving toward said bottle top stop along said common longitudinal axis.

6. The support apparatus as set forth in claim 5, wherein said bottle top stop is commonly formed with and amounts to a cutout from said upper pad portion of one of said obverse exterior foot portions.

7. The support apparatus as set forth in claim 4, wherein said apparatus comprises three bottle cradle portions, and wherein said fourth outward surface of a first one of said three bottle cradle portions and said fourth outward surface of a second one of said three bottle cradle portions are provided back-to-back on opposing sides of a wedge shaped foot having an upper pad portion.

8. The support apparatus as set forth in claim 3, further comprising, on opposing sides of and supporting said second outward surface, at least one interior foot portion, said at least one interior foot portion having a pad portion.

9. The support apparatus as set forth in claim 3, wherein said at least one interior foot portion in a first bottle cradle portion in said plurality of bottle cradle portions commonly supports a third outward surface in a second bottle cradle portion, said third outward surface shaped in an arcuate segment of preselected dimensions adapted for securely receiving a neck portion of a bottle of substantially complementary shape.

10. The support apparatus as set forth in claim 2, wherein each of said plurality of bottle cradle portions further comprises, situated along with said a second outward surface, a interior support foot.

11. The support apparatus as set forth in claim 1, wherein said obverse side of said apparatus comprises three bottle cradle portions.

12. The support apparatus as set forth in claim 1, wherein said plurality of bottle cradle portions comprises a first bottle cradle portion, a second bottle cradle portion, and a third bottle cradle portion, and wherein said first outward surface of said first bottle cradle portion comprises a first interior side portion, and wherein said first outward surface of said second bottle cradle portion comprises a second interior side portion, and wherein said first and said second interior side portions have formed therebetween a central internal foot having a top pad portion.

13. The support apparatus as set forth in claim 12, wherein said central internal foot further comprises an internal bottle top stop, said internal bottle top stop sized and shaped complementary to the top of a bottle adapted to fit into said third bottle cradle portion, said internal bottle top stop adapted to prevent a bottle in said third bottle cradle from moving toward said bottle top stop along said common longitudinal axis.

14. The support apparatus as set forth in claim 1, wherein in each bottle cradle portion, said first bottle bottom receiver is carved out from, and formed by, one of said plurality of obverse exterior foot portions.

15. The support apparatus as set forth in claim 1, wherein each of said plurality of bottle cradle portions further comprises, situated along a common longitudinal axis with said first outward surface, a second outward surface shaped in an arcuate segment of pre-selected dimensions adapted for securely receiving a second segment of said bottle of substantially complementary shape.

16. The support apparatus as set forth in claim 15, wherein each of said plurality of bottle cradle portions further comprises, situated along said common longitudinal axis, a third outward surface shaped in an arcuate segment of preselected dimensions adapted for securely receiving a neck portion of a bottle of substantially complementary shape.

17. The support apparatus as set forth in claim 16, wherein each of said plurality of bottle cradle portions further comprises, along a common axis between said second outward surface and said third outward surface, a fourth outward surface comprising a portion of a surface of revolution of decreasing radius along said common longitudinal axis, said fourth outward surface of complementary size and shape to a shoulder portion of said bottle and adapted to prevent movement of said bottle toward said third surface along said common longitudinal axis.

18. The support apparatus as set forth in claim 17, wherein each of said plurality of bottle cradle portions further comprises, above said fourth outward surface along said common longitudinal axis, a bottle top stop, said bottle top stop sized and shaped complementary to the top of said bottle and adapted to prevent said bottle from moving toward said bottle top stop along said common longitudinal axis.

19. The support apparatus as set forth in claim 17, wherein said reverse side of said apparatus comprises three bottle cradle portions, and wherein said fourth outward surface of a first one of said three bottle cradle portions and said fourth outward surface of a second one of said three bottle cradle portions are provided back-to-back on opposing sides of a wedge shaped foot having an upper pad portion.

20. The apparatus as set forth in claim 16, further comprising, on opposing sides of and supporting said second outward surface, at least one interior foot portion, said at least one interior foot portion having a pad portion.

21. The apparatus as set forth in claim 16, wherein said at least one interior foot portion in a first bottle cradle portion in said plurality of bottle cradle portions commonly supports a third outward surface in a second bottle cradle portion, said third outward surface shaped in an arcuate segment of preselected dimensions adapted for securely receiving a neck portion of a bottle of substantially complementary shape.

22. The support apparatus as set forth in claim 1, wherein said reverse side of said apparatus comprises three bottle cradle portions.

23. The support apparatus as set forth in claim 1, wherein said plurality of bottle cradle portions comprises a first bottle cradle portion, a second bottle cradle portion, and a third bottle cradle portion, and wherein said first outward surface of said first bottle cradle portion comprises a first interior side portion, and wherein said first outward surface of said second bottle cradle portion comprises a second interior side portion, and wherein said first and said second interior side portions have formed therebetween a central internal foot having a top pad portion.

24. The support apparatus as set forth in claim 23, wherein said central internal foot further comprises an internal bottle top stop, said internal bottle top stop sized and shaped complementary to the top of a bottle adapted to fit into said third bottle cradle portion, said internal bottle top stop adapted to prevent a bottle in said third bottle cradle from moving toward said bottle top stop along said common longitudinal axis.

25. The apparatus as set forth in claim 1, wherein said apparatus further comprises (a) a top end, (b) a bottom end, (c) extending inward and downward from said top end and from said bottom end, one or more lateral foot portion each having an interior surface portion, and wherein in each bottle cradle portion, said first bottle bottom stop is raised up from, and formed by an interior surface of, one of said lateral foot portions.

26. The support apparatus as set forth in claim 1, wherein said at least one interior foot portion in a first bottle cradle portion in said plurality of bottle cradle portions in said reverse side commonly supports a third outward surface in a second bottle cradle portion, said third outward surface shaped in an arcuate segment of preselected dimensions adapted for securely receiving a portion of a bottle of substantially complementary shape.

27. The apparatus as set forth in claim 15, wherein said first outward surface in said obverse side comprises a generally semi-circular shape.

28. The support apparatus as set forth in claim 15, wherein said obverse exterior foot portions are angled inward at an angle sigma ($\Sigma$) of about 20 degrees, with respect to a plane perpendicular to said horizontal perimeter wall.

29. The support apparatus as set forth in claim 1, wherein said reverse exterior foot portions are angled inward at an angle beta ($\beta$) of about 20 degrees, with respect to a plane perpendicular to said horizontal perimeter wall.

30. The support apparatus as set forth in claim 15, wherein said support apparatus comprises a strong, flexible plastic material.

31. The support apparatus as set forth in claim 30, wherein said plastic material comprises polyethylene terephthalate.

32. The support apparatus of claim 30, wherein said plastic material is a recycled plastic, material.

33. The support apparatus as set forth in claim 15, wherein said horizontal perimeter wall of said support apparatus is sufficiently thin so that at least 16 support apparatus units are stackable in one inch of stacking height.

34. The support apparatus as set forth in claim 15, wherein said horizontal perimeter wall of said support apparatus is sufficiently thin so that at least 20 support apparatus units are stackable in one inch of stacking height.

35. The support apparatus as set forth in claim 15, wherein said horizontal perimeter wall of said support apparatus is sufficiently thin so that at least 25 support apparatus units are stackable in one inch of stacking height.

36. The support apparatus as set forth in claim 15, wherein said support apparatus comprises translucent plastic.

37. The support apparatus as set forth in claim 36, wherein said translucent plastic comprises a light green see-through shade plastic material.

38. The support apparatus as set forth in claim 15, wherein said apparatus comprises clear, see-through plastic.

39. The support apparatus as set forth in claim 15, wherein said horizontal perimeter wall comprises a plastic wall having a thickness of approximately 30 mils.

40. The support apparatus as set forth in claim 15, wherein said plastic body comprises a see-through plastic.

41. The combination of (a) a plurality of support apparatus units as set forth in claim 1, and (b) a plurality of bottles, wherein (1) a first support layer comprising a support apparatus unit, said support apparatus unit adapted for placement on a supporting substrate, (2) said support apparatus units supporting thereon a 1st tier layer of bottles in a series of layers from 1 to N layers, said 1st tier layer comprising multiple bottles;

(3) a second support layer comprising a support apparatus unit stacked on said 1st tier layer of bottles, to secure said 1st tier layer and to support a second tier layer of bottles;

(4) additional support layers each comprising a support apparatus unit and an additional layer of bottles thereon in a series of 1 to N layers;

(5) a final support apparatus unit above said Nth and final layer of bottles.

42. The combination as set forth in claim 41, wherein said wherein said bottles comprise wine bottles, and wherein said wine bottles include liquid contents.

43. The combination as set forth in claim 41, wherein a first support apparatus is oriented obverse side up, and a second, identical support apparatus is oriented obverse side up.

44. The combination as set forth in claim 41, wherein a first support apparatus is oriented obverse side up, and a second, identical support apparatus is oriented reverse side up.

45. The combination as set forth in claim 44, wherein a plurality of pads of said obverse support foot portions and a plurality of pads of said reverse support foot portions are matched in opposing fashion, so as to assist in the support of the weight of said combination.

46. The combination as set forth in claim 44, further comprising a third support apparatus oriented obverse side up.

47. The combination as set forth in claim 46, further comprising a fourth support apparatus oriented reverse side up.

48. The combination as set forth in claim 44, wherein a first support apparatus is oriented obverse side up, and a second, identical support apparatus is oriented obverse side up.

49. The combination as set forth in claim 41, wherein a first support apparatus is oriented reverse side up, and wherein a second support apparatus is oriented obverse side up, so that a pair of reverse sides are brought together in mating engagement.

50. A support apparatus for receiving and supporting bottles, said support apparatus comprising:

a thermoformed plastic body, comprising (a) a perimeter match layer of preselected thickness, said perimeter match layer having along at least a portion thereof a horizontal perimeter wall extending inwardly for a preselected distance;

(b) an obverse side, said obverse side comprising (i) a plurality of obverse bottle cradle portions, each of said obverse bottle cradle portions comprising (A) a first obverse outward surface shaped in an arcuate segment of pre-selected dimensions adapted for securely receiving a first segment of a bottle of substantially complementary shape, (B) a first obverse bottle bottom receiver, and (ii) a plurality of obverse exterior foot portions, said obverse exterior foot portions extending upwardly above said horizontal perimeter wall for a preselected distance and having an upper pad portion, said obverse exterior foot portions comprising an outer sidewall portion sloping inwardly and upwardly toward its companion upper pad portion; and (c) a reverse side, said reverse side comprising (i) a plurality of reverse bottle cradle portions, each of said reverse bottle cradle portions comprising (A) a first reverse outward surface shaped in an arcuate segment of pre-selected dimensions adapted for securely receiving a first segment of a first reverse bottle of substantially complementary shape, (B) a first reverse bottle bottom end stop, and (ii) a plurality of reverse exterior foot portions, said reverse exterior foot portions extending downwardly below said horizontal perimeter wall for a preselected distance and having a lower pad portion, said reverse exterior foot portions comprising an outer sidewall portion sloping inwardly and downwardly toward its companion lower pad portion.

51. The support apparatus as set forth in claim 50, wherein each of said plurality of obverse bottle cradle portions further comprises, situated along a common longitudinal axis with said first obverse outward surface, a second obverse outward surface shaped in an arcuate segment of pre-selected dimensions adapted for securely receiving a second segment of a bottle of substantially complementary shape.

52. The support apparatus as set forth in claim 51, wherein each of said plurality of obverse bottle cradle portions further comprises, situated along said common longitudinal axis, a third obverse outward surface shaped in an arcuate segment of preselected dimensions adapted for securely receiving a neck portion of a bottle of substantially complementary shape.

53. The support apparatus as set forth in claim 52, wherein each of said plurality of obverse bottle cradle portions further comprises, along a common axis between said second obverse outward surface and said third obverse outward surface, a fourth obverse outward surface comprising a portion of a surface of revolution of decreasing radius along said common longitudinal axis, said fourth outward surface of complementary size and shape to a shoulder portion of said bottle and adapted to prevent movement of said bottle toward said third obverse surface along said common longitudinal axis.

54. The support apparatus as set forth in claim 53, wherein each of said plurality of obverse bottle cradle portions further comprises, above said fourth obverse outward surface along said common longitudinal axis, an obverse bottle top stop, said obverse bottle top stop sized and shaped complementary to the top of a bottle and adapted to prevent a bottle from moving toward said obverse bottle top stop along said common longitudinal axis.

55. The support apparatus as set forth in claim 50, wherein said obverse side of said apparatus comprises three bottle cradle portions.

56. The support apparatus as set forth in claim 50, wherein each of said plurality of reverse bottle cradle portions further comprises, situated along a common longitudinal axis with said first reverse outward surface, a second reverse outward surface shaped in an arcuate segment of pre-selected dimensions adapted for securely receiving a second segment of a bottle of substantially complementary shape.

57. The support apparatus as set forth in claim 56, wherein each of said plurality of reverse bottle cradle portions further comprises, situated along said common longitudinal axis, a third reverse outward surface shaped in an arcuate segment of preselected dimensions adapted for securely receiving a neck portion of a bottle of substantially complementary shape.

58. The support apparatus as set forth in claim 57, wherein each of said plurality of reverse bottle cradle portions further comprises, along a common axis between said second reverse outward surface and said third reverse outward surface, a fourth reverse outward surface comprising a portion of a surface of revolution of decreasing radius along said common longitudinal axis, said fourth reverse outward surface of complementary size and shape to a shoulder portion of a bottle and adapted to prevent movement of a bottle toward said third reverse surface along said common longitudinal axis.

59. The support apparatus as set forth in claim 58, wherein each of said plurality of reverse bottle cradle portions further comprises, above said fourth reverse outward surface along said common longitudinal axis, a reverse bottle top stop, said reverse bottle top stop sized and shaped complementary to the top of a bottle and adapted to prevent a bottle from moving toward said reverse bottle top stop along said common longitudinal axis.

60. The support apparatus as set forth in claim 50, wherein said reverse side of said apparatus comprises three bottle cradle portions.

61. The support apparatus as set forth in claim 50, wherein said plastic body comprises a see-through plastic.

62. The support apparatus of claim 50, wherein said plastic comprises a recycled plastic, material.

63. The support apparatus as set forth in claim 50, wherein said horizontal perimeter wall of said support apparatus is sufficiently thin so that at least 16 support apparatus units are stackable in one inch of stacking height.

64. The support apparatus as set forth in claim 50, wherein said horizontal perimeter wall of said support apparatus is sufficiently thin so that at least 20 support apparatus units are stackable in one inch of stacking height.

65. The support apparatus as set forth in claim 50, wherein said horizontal perimeter wall of said support apparatus is sufficiently thin so that at least 25 support apparatus units are stackable in one inch of stacking height.

66. The support apparatus as set forth in claim 50, wherein said support apparatus comprises translucent plastic.

67. The support apparatus as set forth in claim 66, wherein said translucent plastic comprises a light green see-through shade plastic material.

68. The support apparatus as set forth in claim 50, wherein said apparatus comprises clear, see-through plastic.

69. The support apparatus as set forth in claim 50, wherein said horizontal perimeter wall comprises a plastic wall having a thickness of approximately 30 mils.

* * * * *